US005481978A

United States Patent [19]

Müller et al.

[11] Patent Number: 5,481,978

[45] Date of Patent: Jan. 9, 1996

[54] CARTRIDGE CASE

[75] Inventors: Friedrich Müller, Bechhofen; Heinz Riess, Fürth, both of Germany

[73] Assignee: Dynamit Nobel Aktiengesellschaft, Troisdorf, Germany

[21] Appl. No.: 351,178

[22] Filed: Nov. 30, 1994

[30] Foreign Application Priority Data

Dec. 1, 1993 [DE] Germany ..... 43 40 998.9
Dec. 1, 1993 [DE] Germany ..... 43 41 002.2

[51] Int. Cl.[6] ..... F42B 5/26

[52] U.S. Cl. ..... 102/470; 102/430

[58] Field of Search ..... 102/204, 430, 102/464–470, 472

[56] References Cited

U.S. PATENT DOCUMENTS 431,601 7/1890 Lorenz ..... 102/470
3,306,203 2/1967 Schaadt et al. ..... 102/470
4,173,186 11/1979 Dunham ..... 102/430
5,157,219 10/1992 Calsson et al. ..... 102/470

FOREIGN PATENT DOCUMENTS 0461095 12/1991 European Pat. Off. .
73301 1/1894 Germany ..... 102/470

*Primary Examiner*—Harold J. Tudor
*Attorney, Agent, or Firm*—Antonelli, Terry, Stout & Kraus

[57] ABSTRACT

A cartridge case especially for firing in handguns has a primer receiving pocket provided in the bottom or rear portion as a cylindrical recess, into the top of which at least one flash hole terminates, a primer cap mounted flush in the primer receiving pocket including a cup-shaped capsule having a capsule bottom and a cylindrical side wall, and with a primer charge and an anvil located inside the capsule.

To improve gas tightness in the direction of the breech of the gun, especially in the use of pollutant-free primer charges, the primer receiving pocket is provided in the vicinity of a side wall of the capsule with an annular circumferential expansion zone, so that the anvil has room to deflect after ignition of the primer charge and expansion of the capsule.

6 Claims, 3 Drawing Sheets

FIG. 5a
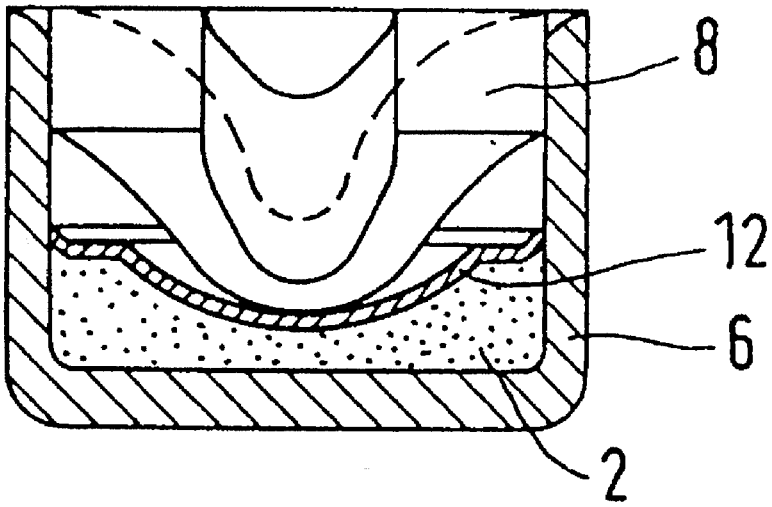
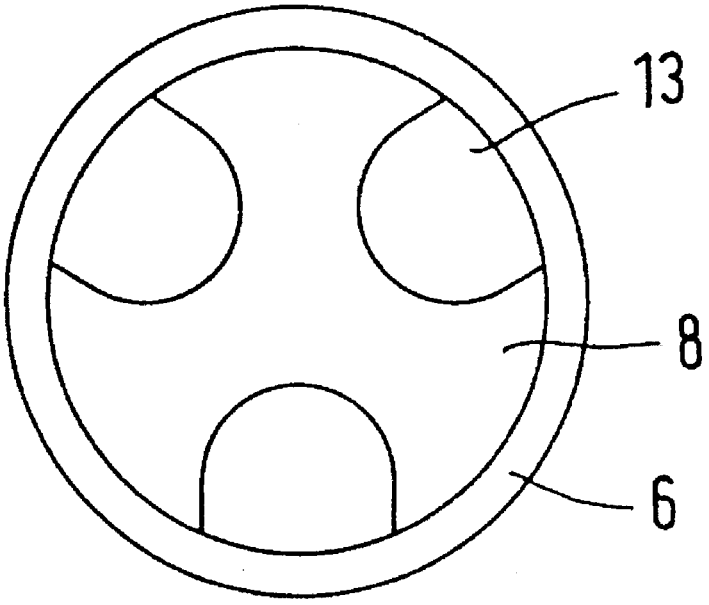
FIG. 5b

CARTRIDGE CASE

FIELD OF INVENTION

This invention relates to a cartridge case, especially for firing in handguns, which has a cylindrical rear portion provided with a primer receiving pocket or chamber, containing a primer cap and provided with an expansion zone which prevents escape of gas towards the breech of a gun during firing.

BACKGROUND OF THE INVENTION

To ignite a propellant charge in a cartridge case, it is known to use primer caps. FIGS. 1 and 2 each show in section, the rear end of a casing of a cartridge case according to the prior art with the primer cap in place before (FIG. 1) and after (FIG. 2) ignition.

A cylindrical case 1 is provided at its rear end with a primer receiving pocket or chamber 4 in the form of a cylindrical recess. Flash holes 11 in a rear portion of the case terminate in the top of primer receiving pocket 4, said flash holes communicating with a propellant charge, not shown, inside a cavity in the case 1. A primer cap is mounted flush in the primer receiving pocket 4. The primer cap consists of a cup-shaped capsule 6 with a planar capsule bottom and a cylindrical side wall. A primer charge 2 is pressed into the interior of the capsule 6 on the bottom of the capsule. Above primer charge 2 is an anvil 8 with openings for passage of gases. The primer cap is anchored in the case 1 by annular riveting 3.

When the firing pin 5 of a weapon strikes the bottom of the capsule (see FIG. 2), the capsule is deformed. This suddenly compresses primer charge 2 between the bottom of the capsule and anvil 8, causing the charge to explode. The resulting hot gases pass through the openings in anvil 8 to flash holes 11 and from there to the propellant charge, not shown, and then ignite the charge.

The cartridge cases to be fired in handguns must exhibit gas tightness in the direction of the breech, in order to reliably prevent any danger to the shooter or damage to the weapon. In particular, pollutant-free primer caps are richer in gas than the former types containing particles and in part, pollutants. As a result, much higher gas pressures develop during firing in the area of the primer receiving pocket, with a very brief pressure rise. This can cause gas to escape in the vicinity of the primer cap, which can be seen, in particular, in unlocked weapons with a breech and a rigid, permanently attached firing pin.

This gas escape is shown as an example in FIG. 2. The material of the capsule bottom is plastically deformed to a great extent in critical area 7 between the fixed anvil 8 of the primer cap and firing pin 5 which cannot move back because of its rigid connection with the lock at the moment of ignition. As a result of the high gas pressure from the pollutant-free primer cap, the material of the capsule bottom can be stressed above the limit of elongation at rupture (thinning leading to a break) in area 7, which can lead to the escape of gas in the direction of the breech or to a migration of the primer cap and hence to a leak or a "back blast".

Primer caps like those described above are shown for example in DE-OS 20 04 506 and DE-OS 27 08 525.

SUMMARY OF THE INVENTION

The goal of the invention is to provide a cartridge case, especially for firing in handguns, in which gas tightness in the direction of the breech is considerably improved, especially with gas-rich and pollutant-free primer charges.

According to the invention, this goal is achieved by the primer receiving pocket being provided with an annular expansion zone in the vicinity of the upper portion of a side wall of the cup-shaped capsule, so that the anvil has room to recede following ignition of the primer charge and expansion of the capsule.

The cartridge case according to the invention is suitable for use not only in handguns but also for automatic pistols, rifles, and the like.

Under pressure, the side wall of the capsule can recede into the adjoining expansion zone. This raises the seat of the anvil, so that it can deform in the radial direction, i.e. it can recede. This means that the stresses in the critical area of the capsule bottom are so markedly reduced that no thinning of the material forming the capsule bottom occurs and the deformations in the material of the capsule bottom remain within the limits of plastic elongation. Escape of gas in the direction of the breech is thus prevented.

According to the invention, the expansion zone is located in the area that adjoins the top of a cylindrical portion of the primer receiving pocket, so that the free end of the capsule that faces away from the capsule bottom can be deflected into the expansion zone under pressure.

Preferably the expansion zone is made wedge-shaped or conical in cross section. However, other shapes are also possible for example a round profile, a triangular profile or other geometries. The greatest depth of the expansion zone according to the invention is provided in the portion that abuts the interior wall of the casing forming the top of the primer receiving pocket.

In a preferred embodiment, a stop acting in the radial direction is provided in the rear portion of the case between the expansion zone and the top of the primer receiving pocket for the free end of the cylindrical side wall of the capsule.

Advantageously the expansion zone covers nearly half of the length of the side wall of the capsule.

BRIEF DESCRIPTION OF THE DRAWINGS

The invention will now be described in greater detail with reference to the accompanying drawings wherein:

FIGS. 5*a* and 5*b* are, respectively, is a section and a top view of a primer cap or primer element according to the embodiment shown in FIG. 3.

FIGS. 1 and 2 show the prior art (heretofore described in the Background of the Invention).

DETAILED DESCRIPTION OF THE INVENTION

Figure 1:
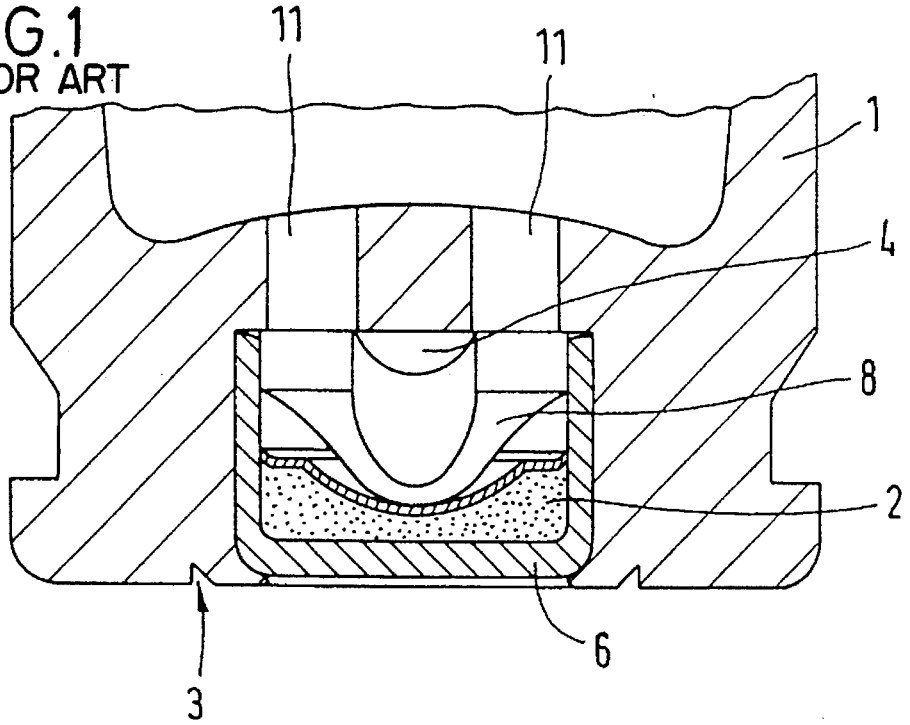
FIG.1 PRIOR ART
FIG. 1 is a lengthwise section of a rear portion of a cartridge case with a primer cap prior to ignition of the primer charge, according to the prior art.
Figure 2:
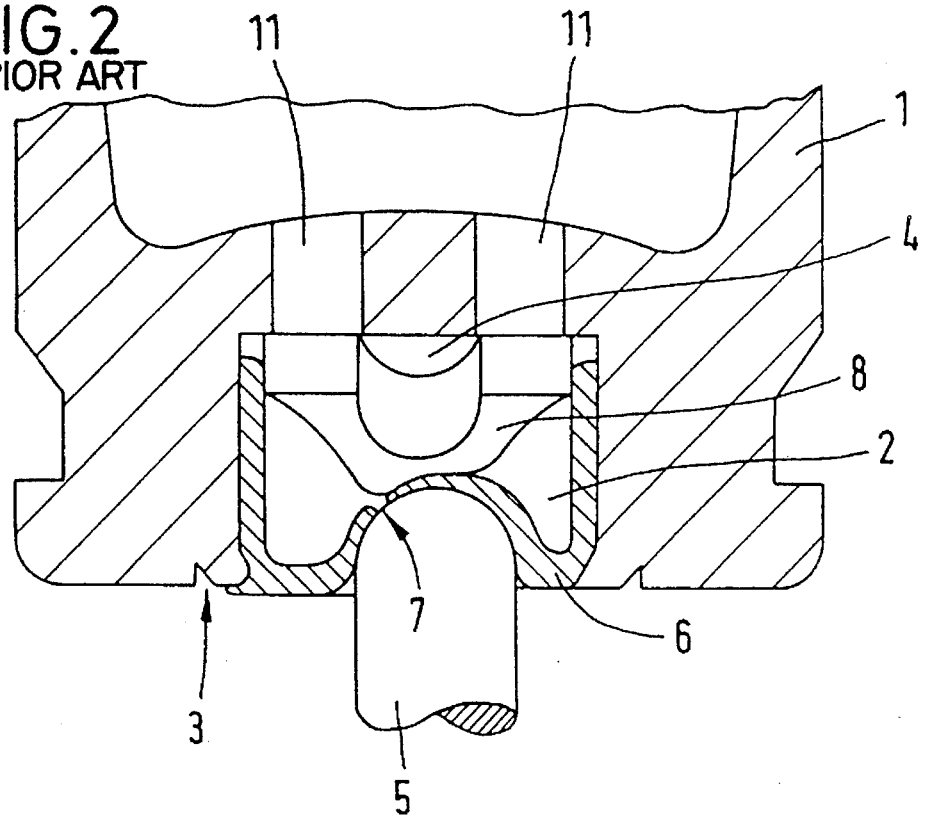
FIG.2 PRIOR ART
FIG. 2 is a section through the cartridge case of FIG. 1 following ignition of the primer charge.
Figure 3:
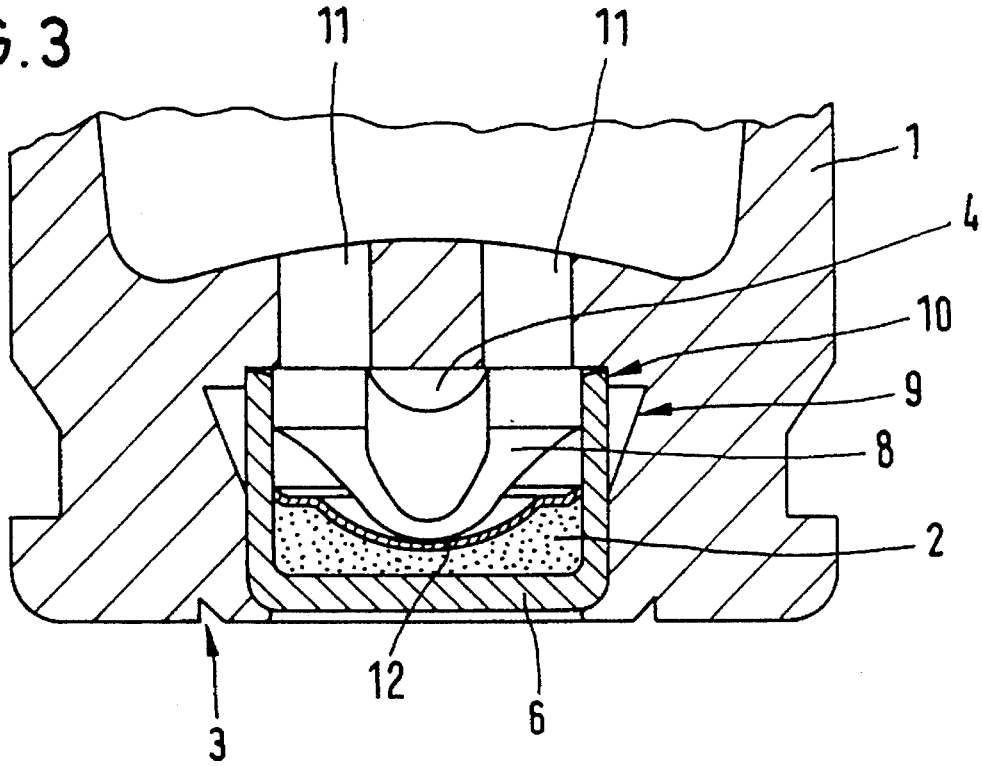
FIG. 3 is a section through a cartridge case according to the invention prior to the ignition of the primer charge.

FIG. 3 shows a section of a cartridge case according to the invention before the ignition of the primer charge. A cylindrical rear portion of the case 1 is provided with a cylindrical recess at its bottom end, which faces a firing pin not shown in this figure, said recess forming a primer receiving pocket 4. Flash holes 11 terminate in the top of primer receiving pocket 4, said flash holes communicating with a propellant charge, not shown, in the interior of case 1. A primer cap is pressed flush with the bottom of case 1 into primer receiving pocket 4. The primer cap is held firmly in case 1 by additional annular riveting 3.

The primer cap consisting of a primer charge 2 and a cup-shaped capsule 6 having a capsule bottom and cylindrical side wall. The opening of capsule 6 faces flash holes 11.

The primer charge 2 is pressed into the bottom of the capsule, and protected by a cover 12. Cover 12 can be, for example, a varnish coat or a film.

An anvil 8 rests on primer 2 and cover 12. This anvil is described in greater detail with reference to FIG. 5. Anvil 8 is a separate component i.e. it is not made integral with case 1 and has a jacket surface resting against the openings or recesses, completely against the inside of the side wall of capsule 6. In the lengthwise direction of case 1, anvil 8 abuts an interior wall of the case defining the top of primer receiving pocket 4 at one end and primer charge 2 at the other. The openings 13 in anvil 8 are arranged so that the gases can reach flash holes 11.

According to the invention, primer receiving pocket 4 is provided in the vicinity of the side wall of capsule with an expansion zone 9. FIG. 3 shows an embodiment in which expansion zone 9 is made wedge-shaped or conical in cross section. The maximum depth of expansion zone 9, viewed in the radical direction, is therefore, provided on the top of primer receiving pocket 4. The word "top" refers to the end of the primer receiving pocket in which flash holes 11 terminate.

Expansion zone 9 represents a circumferential undercut of the side interior walls of the rear portion of the case that define the primer receiving pocket 4, and acts as a radial yield space, free space, expansion space, or undercut for the side wall of capsule 6 and hence for anvil 8 as well.

Expansion zone 9 is set back roughly axially in the direction of the bottom of capsule 6 from the top of primer receiving pocket 4, so that between expansion zone 9 and the top of primer receiving pocket 4 a stop 10 is formed in the casing interior wall for the anterior free end of the cylindrical side wall of capsule 6. Stop 10 serves to guide the free end of the side wall and as a protection against blowby in the initial phase of ignition, thus ensuring that the pressure in expansion zone 9 is always less than the pressure in capsule 6 and hence a reliable expansion of the side wall is possible. Expansion zone 9 extends over nearly half the axial length of the side wall of capsule 6.

FIGS. *5a* and *5b* show a section and top view of a known primer cap, respectively. The primer cap is identical to the one shown in FIG. 3. In the top view, openings 13 in anvil 8 can be seen, through which the gases reach flash holes 11 (see FIG. 3).

Figure 4:
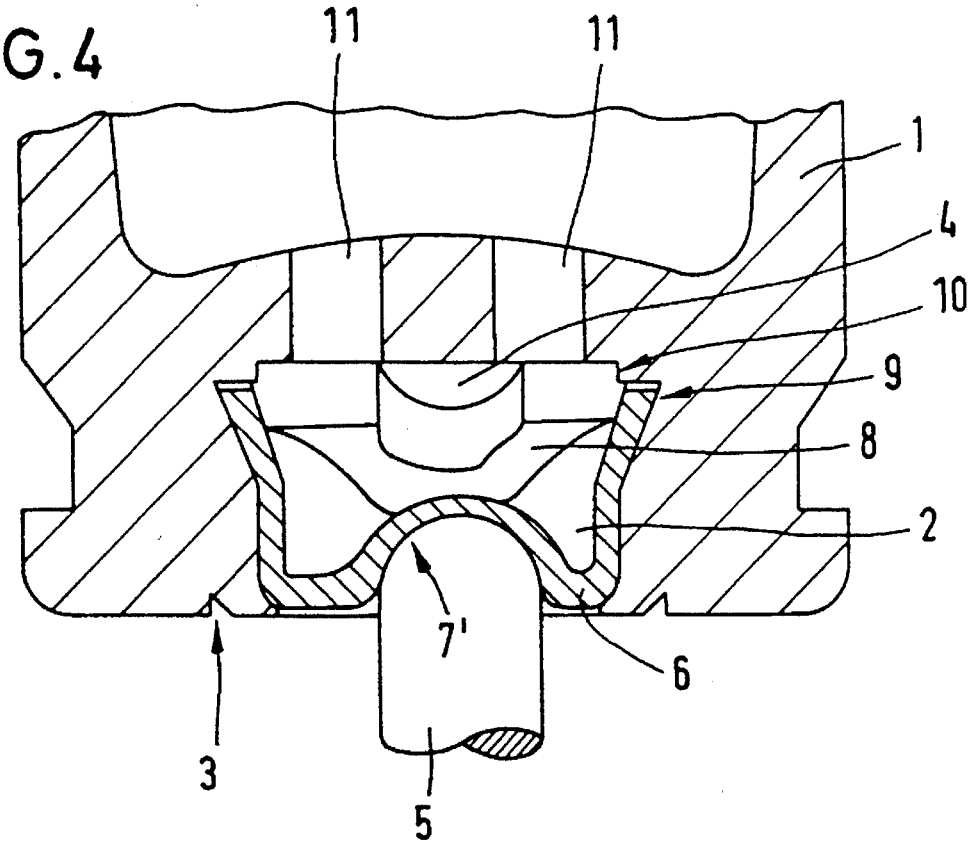
FIG. 4 is a section through the cartridge case according to FIG. 3 following ignition of the primer charge.

FIG. 4 shows a lengthwise section through the rear end of a cartridge case according to the invention following ignition of the primer charge.

A firing pin 5 has indented the capsule bottom of capsule 6 and, in the case of a rigid permanently connected firing pin 5, remains in this position. This is the case in unlocked weapons with a breech block.

Primer charge 2, located between the capsule bottom and anvil 8, has been ignited by the impact of firing pin 5. Deformation of the capsule bottom by firing pin 5 causes the free end of the side wall of capsule 6 to be pulled away from the top of primer receiving pocket 4 and stop 10 in the direction of the capsule bottom. This end can thus expand into expansion zone 9. Anvil 8, severely deformed by firing pin 5 or the capsule bottom, can expand radially, so that its height is reduced in a lengthwise direction and thus its area opposite firing pin 5 can yield in the forward direction. In the capsule bottom, in the vicinity of reference numeral 7', no stresses are developed that are so high that the stresses could cause a rupture of the capsule bottom. Gas tightness in the direction of the breech is thus ensured.

It should be pointed out that in the case of pollutant-free and gas-rich primer charges, pressure peaks up to about 2000 bar can develop, while in the case of primer charges containing pollutants, pressure peaks of only about 1000 bar can develop.

What is claimed is:

1. A cartridge case for firing in handguns, which comprises a primer receiving pocket formed in a rear portion of the case as a cylindrical recess, at least one flash hole terminating in a top portion of the pocket, a primer cap mounted flush in the primer pocket, said cap comprising a cup-shaped capsule that consists of a capsule bottom and a cylindrical side wall and a primer charge located inside the capsule, and an anvil positioned above the primer charge and contained in the capsule, said primer receiving pocket being provided, in a vicinity of a side wall of the capsule, with an annular circumferential expansion zone, said expansion zone being provided in an area of the rear portion of the case adjoining the top portion of the primer receiving pocket to allow an end portion of the cylindrical side wall to expand into the expansion zone so that the anvil located near the end portion of the cylindrical side wall, following ignition of the primer charge and expansion of the capsule, has room to deflect outwardly thereby avoiding rupture of the capsule bottom during deformation by a firing pin.

2. A cartridge case according to claim 1, wherein the expansion zone is made wedge-shaped in cross section and is provided with a maximum depth in an area that adjoins the top portion of the primer receiving pocket.

3. A cartridge case according to claim 1, wherein a stop is provided on an interior wall of the rear portion of the case between the expansion zone and the top portion of primer pocket for engaging an end of a cylindrical side wall of the capsule.

4. A cartridge case according to claim 2, wherein a stop is provided on an interior wall of the rear portion of the case between the expansion zone and the top portion of primer pocket for engaging an end of a cylindrical side wall of the capsule.

5. A cartridge case according to claim 1, wherein the expansion zone extends over nearly half the length of a side wall of the capsule.

6. A cartridge case according to claim 2, wherein the expansion zone extends over nearly half the length of a side wall of the capsule.

* * * * *